US006663925B1

(12) United States Patent
Swoboda

(10) Patent No.: US 6,663,925 B1
(45) Date of Patent: Dec. 16, 2003

(54) PAPERBOARD CONTAINER HAVING ENHANCED RIGIDITY AND A METHOD OF MAKING THE SAME

(75) Inventor: Dean Swoboda, DePere, WI (US)

(73) Assignee: Fort James Corporation, Atlanta, GA (US)

( * ) Notice: Subject to any disclaimer, the term of this patent is extended or adjusted under 35 U.S.C. 154(b) by 0 days.

(21) Appl. No.: 09/249,485

(22) Filed: Feb. 12, 1999

(51) Int. Cl.[7] ..... B29D 22/00; B29D 23/00; B32B 1/08

(52) U.S. Cl. ..... 428/34.2; 428/35.7; 428/36.8; 428/511; 493/330; 493/167; 229/5.87; 229/5.84; 427/411

(58) Field of Search ..... 428/34.2, 35.7, 428/36.8, 511; 493/330, 167; 229/5.81, 5.84; 427/411

(56) References Cited

U.S. PATENT DOCUMENTS

| | | | | |
|---|---|---|---|---|
| 2,601,598 A | | 6/1952 | Daniel, Jr. et al. | 162/167 |
| 3,849,184 A | | 11/1974 | Roberts | 428/337 |
| 4,391,833 A | | 7/1983 | Self et al. | 429/523 |
| 5,545,449 A | * | 8/1996 | Tiedeman | 428/34.2 |
| 5,603,996 A | * | 2/1997 | Overcash et al. | 428/34.2 |
| 5,776,619 A | * | 7/1998 | Shanton | 427/411 |
| 5,837,383 A | * | 11/1998 | Wenzel et al. | 428/511 |

FOREIGN PATENT DOCUMENTS

| | | |
|---|---|---|
| EP | 543764 | 5/1993 |

* cited by examiner

*Primary Examiner*—Kenneth R. Rice
(74) *Attorney, Agent, or Firm*—Finnegan, Henderson, Farabow, Garrett & Dunner, L.L.P.

(57) ABSTRACT

The invention is directed to a container press-formed of paperboard having a top surface disposed for contact with material to be contained and an opposed bottom surface, the container comprising a first functional coating material such as a latex dispersed in the paperboard without forming a barrier to moisture. The invention also encompasses a method of manufacturing the press-formed paperboard container comprising before the container is press-formed the step of applying to the bottom surface of the paperboard a moistening solution comprising latex solids in an amount selected to avoid forming a moisture barrier and to avoid blistering on the bottom surface during press forming.

20 Claims, 1 Drawing Sheet

PAPERBOARD CONTAINER HAVING ENHANCED RIGIDITY AND A METHOD OF MAKING THE SAME

FIELD OF THE INVENTION

This invention pertains to press-formed paperboard containers, such as paper plates, paper trays, paper cups and the like. In particular, this inventions pertains to paperboard containers having enhanced rigidity and the method of making such containers.

BACKGROUND OF THE INVENTION

Many efforts have been made to improve the strength and rigidity of the paperboard containers economically. For example, the inventions disclosed in U.S. Pat. Nos. 4,609,140 and 4,606,496 provided paperboard containers having improved rigidity obtained by optimizing the amount and location of pressure applied during press-forming of the containers. The disclosures of the two prior art patents are incorporated herein by reference to provide disclosure of currently conventional methods of forming press-formed paperboard containers.

In the common process, paperboard web after drying is passed through a size press to apply starch sizing or other binders to both surfaces of the web. After smoothing the surfaces, the web surface that will be used as the top or upper surface of a container, such as a plate or bowl, is coated with at least one functional coating material that forms a barrier to moisture. Such a barrier is intended to prevent moisture from the food or drink placed in the container from wetting the paperboard. Many layers of functional coating material may be placed on the upper surface. In some products, the upper surface may also be printed, the printing then being covered with one or more layers of functional coating material to preclude contact between the printing ink and food placed on or in the container. The coated paperboard is then rolled.

To form paperboard containers from the sized and coated paperboard stock, the paperboard web is moistened on the un-coated lower surface to achieve a predetermined level of moisture in the paperboard. The moisture content aids in deformation of the paperboard during press forming into the desired container shape. The moisture is generally added by a common device known as a flooded nip in amounts sufficient to achieve about 8–12% moisture. Since paperboard when dry contains about 3–6% moisture, the flooded nip can add up to about 6% additional moisture. While water is a preferred moistening medium, some moistening solutions contain wax and surfactant, the former to act as a lubricant in the pressing operation and the latter to assist in moisture penetration. An available concentrate for a moistening solution is VELVETOL® sold by Rhone-Poulenc of Cranbury, N.J.; it contains polyolefin wax and ethoxylated surfactant.

The moistened paperboard web may be rolled and cured for up to 24 hours after which it is die-cut into blanks having the shape and dimensions appropriate for the container to be made. Each blank is then fed into a die press in which mating dies, heat and pressure work to form the paperboard blank into the desired container.

In evaluating the process for making paperboard containers, the inventor has determined that application of a functional coating material to the lower surface of the paperboard, that is the surface that is not intended to contact food or drink, improved container rigidity without adversely effecting production or quality of the containers. The invention is contrary to generally accepted approaches in the field. As noted above, functional coating material is normally applied to form a barrier to moisture. If moisture-proof functional coating material were applied to both surfaces of a paperboard blank, moisture in the blank that is necessary for press forming would be trapped resulting in blistering of the surface coating or rupture of the paperboard during press forming.

The object of the invention, therefore, is to improve container rigidity by application of a functional coating material to the non-functional surface of the container. In this application, the preferred functional coating used is a diluted latex. Latex is known for its bonding and adhesion characteristics and for plasticity under heat and pressure.

SUMMARY OF THE INVENTION

As embodied and broadly described herein, the invention is a container press-formed of paperboard having a top surface disposed for contact with material to be contained and an opposed bottom surface, the container comprising a first functional coating material dispersed in the paperboard proximate the bottom surface without forming a barrier to moisture.

In preferred embodiments, a second functional coating material is disposed on the top surface in quantities sufficient to form a barrier to moisture.

Preferably, the first functional coating material in the bottom surface is the same as the second functional coating material on the top surface. The first functional coating material preferably is a latex. In the presently preferred embodiment, the first functional coating material is TYKOTE® BASE II distributed by Reichold, Inc. of Research Triangle Park, N.C. TYKOTE® BASE II is a modified styrene butadiene polymer. The container of the invention preferably comprises first functional coating material at about 0.5 pounds per ream of paperboard, a ream of paperboard being 3000 sq. ft.

The invention further contemplates a method of making the container of the invention comprising the steps of forming the paperboard; applying a solution of water and the first functional coating material to the bottom surface, the amount of first functional coating material in the solution being selected to avoid formation of a barrier to moisture on the bottom surface; cutting a blank for the container from the paperboard; and press-forming the blank at a predetermined temperature and pressure to form the container.

Preferably, the amount of first functional coating material in the moistening solution is selected to avoid blister formation during press-forming of the containers. In a preferred embodiment, the moistening solution includes about 10% solids from the first functional coating material.

The accompanying drawings, which are incorporated herein and constitute a part of this specification, illustrate an embodiment of the invention, and, together with the description, serve to explain the principles of the invention.

DESCRIPTION OF THE PREFERRED EMBODIMENT

Figure 1:
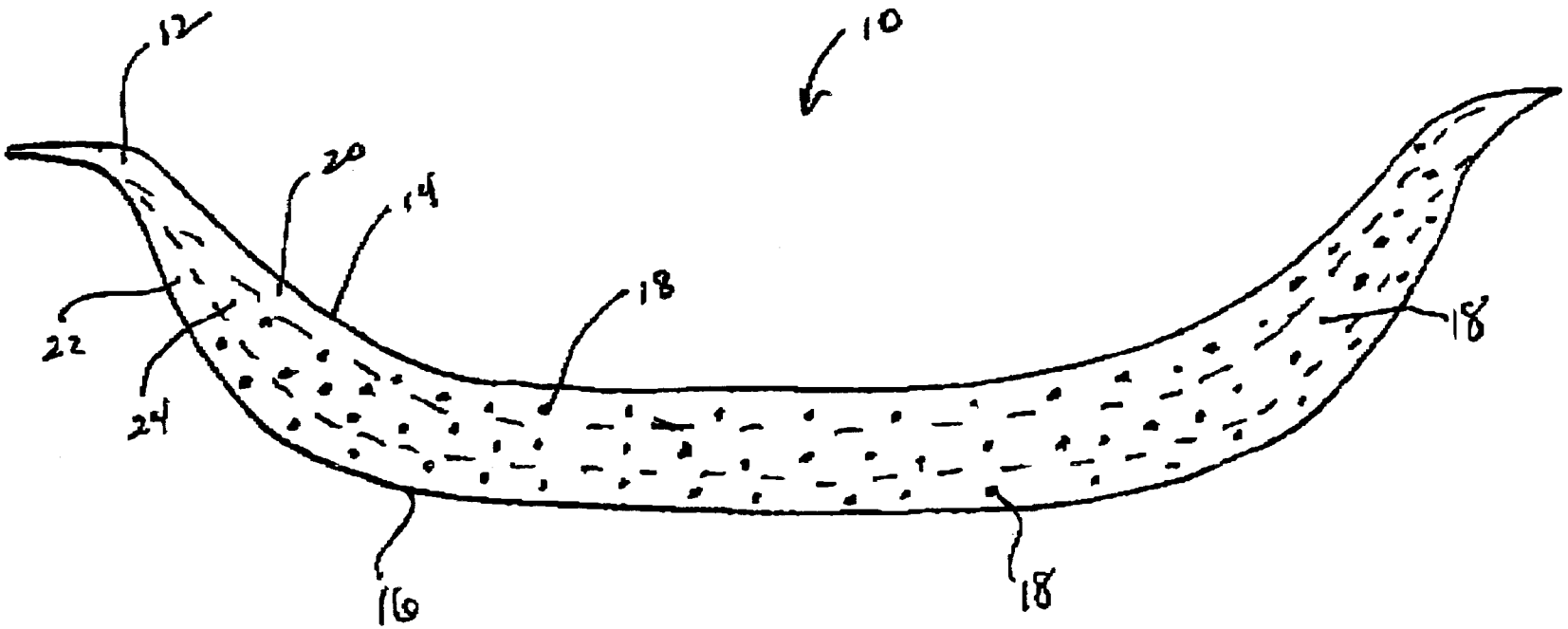
FIG. 1 is a cross section of a paperboard container illustrating possible mechanisms by which the invention improves container rigidity.

Reference will now be made in detail to the present preferred embodiment of the invention, an example of which is illustrated in the accompanying drawings.

In accordance with the invention, the container is press-formed of paperboard having opposed top and bottom surfaces. As illustrated in FIG. 1, container 10 is press-formed from paperboard 12 having a top surface 14 and a bottom surface 16. The paperboard may be any cellulosic fiber web having weight and surface characteristics known to be useful for containers. Preferably, the paperboard has a basis weight of 162 pounds per ream (3000 sq. ft.), although the invention may provide improved rigidity and other improved performance characteristics using paperboard at 200 pounds per ream or other weights.

Further in accordance with the invention, the press-formed paperboard container comprises a first functional coating material dispersed in the paperboard without forming a barrier to moisture. As embodied herein and depicted in FIG. 1, first functional coating material 18 is dispersed in paperboard 12.

In a traditional paperboard container, both top and bottom surfaces 14, 16 are size pressed. As depicted using dashed lines in FIG. 1, the paperboard of the container can be divided into roughly three equal cross-sectional regions. Top region 20 proximate the top surface is defined by the depth of size penetration from top surface 14. Bottom region 22 proximate the bottom surface is defined by the depth of size penetration from the bottom surface 16. The middle region 24, sometimes called the fiber core, is defined by the top and bottom regions 20, 22.

The representation of dispersion of first functional coating material 18 in FIG. 1 is an estimation. Because of dilution, it is believed that first function coating material migrates wherever water applied to the bottom surface migrates. Thus, first functional coating material 18 is believed to migrate through bottom and middle regions 22, 24, and at least through the top region 20 until reaching the first moisture barrier, such as the initial clay coating on top surface 14. The exact distribution of the first functional coating material in the paperboard is not presently known because, at the dilute levels used, it is presently difficult to visually identify the first functional coating material in the paperboard after container formation. Moreover, existing uncertainty regarding how the material operates to provide the measured benefits makes it difficult to suggest the extent of first functional coating material 18 distribution. As noted below, the presence of the first functional coating material in the container of the invention is evident from its application and the subsequent statistically significant improvement on container rigidity.

As explained more fully below, the quantity of first functional coating material 18 applied to the bottom surface during production of the container is limited to preclude formation of a moisture barrier on the bottom surface. Examination of paperboard containers made in accordance with the invention show that no layer of functional coating material exists on the bottom surface. The lack of such a moisture barrier is evident during press forming since a moisture barrier on the bottom surface would prevent necessary dissipation of moisture during pressing resulting in blistering or in destruction of the container. Empirical data suggests that the amount of first functional coating material in the bottom surface of a preferred embodiment of the container is about one-half (½) pound per ream, a ream being 3000 sq. ft. of paperboard.

Preferably, the first functional coating material is selected from the group of ployethylene, polypropylene, nitrocellulose, polyethylene terephthalate, Saran and styrene acrylic acid copolymers, methyl cellulose, carboxymethyl cellulose acetate copolymer, vinyl acetate copolymer, styrene butadiene copolymer, and styrene-acrylic copolymer. Other latex polymers may be used. In the preferred embodiment, the first functional coating material is primarily styrene butadiene rubber, specifically TYKOTE® BASE II distributed by Reichold, Inc. of Research Triangle Park, N.C. TYKOTE® BASE II includes a surfactant. Other latex polymers also may contain a surfactant that may aid migration of the latex in paperboard.

In traditional paperboard containers, top surface 14, the surface subject to use and/or printing, is generally also coated with clay to define a printing surface and with one or more functional coating materials. Thus, in a preferred embodiment, the container of the invention includes a second functional coating material on the top surface forming a barrier to moisture. Preferably, any known functional coating for the top surface of paperboard containers may be applied in any known manner. The second functional coating may be selected from food-safe polymers such as ployethylene, polypropylene, nitrocellulose, polyethylene terephthalate, Saran and styrene acrylic acid copolymers, methyl cellulose, carboxymethyl cellulose acetate copolymer, vinyl acetate copolymer, styrene butadiene copolymer, and styrene-acrylic copolymer. There may be a number of layers of second functional coating material on the top surface of the container depending on the intended uses of the container and on whether the container's top surface is printed with an ink that must be isolated from contact with consumables.

In accordance with the invention, the method of manufacturing the press-formed container of the invention comprises before press-forming the container the step of applying to the bottom surface of paperboard a moistening solution comprising latex solids in an amount selected to avoid formation of a barrier to moisture on the bottom surface and therefore to avoid blistering on the bottom surface during press forming. The latex solids in the moistening solution preferably are from a first functional coating material.

In initial laboratory evaluation of the invention, solutions comprising between 10 and 40 percent functional coating material solids were applied to the bottom surface of the paperboard before press forming. Upon forming the container, blistering in the bottom surface occurred in all test samples having more than 10% solids in the moistening solution. The amount of blistering in the bottom surface varied directly with the percentage of coating material solids in the moistening solution. The blistering indicated that the first functional coating material, unless sufficiently diluted when applied, formed a barrier to moisture which blistered upon being subjected to heat and pressure in the press. Where the amount of first functional coating material was high, the rapid application of heat and pressure during press forming cause the paperboard blank to separate into halves thereby destroying the container. Thus, as broadly embodied herein, the solution used in the method of the invention preferably comprises about 10% solids from the first functional coating material and water.

The currently contemplated best mode of the invention includes preparation of the solution by adding the first functional coating material to the pre-existing moistening solution. The pre-existing moistening solution used is a solution of 50 parts water and one part Velvetol® as sold by Rhone-Poulenc of Cranbury, N.J. The moistening solution used, therefore, contains water, a surfactant and a wax. A first functional coating material, namely TYKOTE® BASE II, a styrene butadiene polymer distributed by Reichold, Inc.

of Research Triangle Park, N.C., is added to the moistening solution to achieve a 10% concentration of Tykote solids. As the Tykote product normally is 40T latex solids, the Tykote functional coating material is diluted with water before being added to the moistening solution.

The enhanced rigidity of paperboard containers made in accordance with the method of the invention was first confirmed in a laboratory evaluation. A roll of 156 pound per ream paperboard having a functional coating on the top surface was moistened on the bottom surface with alternating moistening solutions for alternating 300 linear foot sections. The control solution was the standard moistening solution containing 50 parts water and one part VELVETOL®. The other moistening solution contained 10% TYKOTE solids as described in the immediately preceding paragraph. Both solutions were applied at a rate of 200 feet per minute using a Faustel moistening deck to achieve a moisture content in the paperboard of about 5.5% to about 9.0%. About one-half (½) pound per ream (3000 sq. ft.) of coating material was applied. After moistening, the roll was placed in an air-tight wrapping for 72 hours to achieve equilibrium.

The moistened roll was then used to make 9" paper plates under standard press conditions. The paperboard was unrolled; no blocking (adhesive sticking) was encountered. Blanks were cut, scored and press-formed from the paperboard at 55 strokes per minute. The press temperature was 300° F. The plates formed thereby were then tested for dry rigidity using the Plate Rigidity Tester, Model ML443 1-2, as available from Fort James Corporation, Neenah Technical Center, Neenah, Wis. The following table provides the test results.

| SAMPLE | QUANTITY OF PLATES | BASIS WEIGHT | MOISTENING SOLUTION | MEAN RIGIDITY[1] |
|---|---|---|---|---|
| 1 | 20 | 162 LBS/REAM | Standard[2] | 138.800 |
| 2 | 20 | 162 lbs/ream | Standard + Tykote[3] | 165.300 |
| 3 | 20 | 162 lbs/ream | Standard | 151.850 |
| 4 | 18 | 162 lbs/ream | Standard + Tykote | 160.556 |
| 5 | 20 | 162 lbs/ream | Standard | 151.950 |
| 6 | 20 | 162 lbs/ream | Standard + Tykote | 159.700 |
| 7 | 20 | 162 lbs/ream | Standard | 145.100 |
| 8 | 20 | 162 lbs/ream | Standard + Tykote | 153.900 |
| 9 | 20 | 162 lbs/ream | Standard | 145.300 |
| 10 | 20 | 162 lbs/ream | Standard_Tykote | 151.200 |
| 11 | 20 | 162 lbs/ream | Standard | 144.500 |
| 12 | 20 | 162 lbs/ream | Standard + Tykote | 161.900 |
| 13 | 20 | 162 lbs/ream | Standard | 144.000 |
| 14 | 20 | 162 lbs/ream | Standard_Tykote | 163.000 |
| 15 | 20 | 162 lbs/ream | Standard | 131.400 |
| 16 | 20 | 162 lbs/ream | Standard + Tykote | 153.200 |
| 17 | 20 | 162 lbs/ream | Standard | 141.450 |

[1]Grams per ¼" deflection.
[2]Standard Moistening Solution is 50 parts water and one part Velvetol ®, a moistening solution of wax and surfactant
[3]Standard + Tykote is the Standard Moistening Solution plus a 10% concentration of Tykote ® Base II solids, a styrene butadiene polymer The test data, summarized in the table above, established that application of a moistening solution comprising 10% solids of TYKOTE® BASE II, a styrene butadiene polymer, to the lower surface of the paperboard before press-forming the container improved plate rigidity about 10%, from an average of 143 grams to an average of 158 grams per ¼ inch deflection.

The statistically significant improvement in paperboard container rigidity obtained in the laboratory was subsequently confirmed on a standard paper plate production line. The standard moistening solution was replaced by the standard solution including 8% solids of Tykote Base II. The moistening solution was applied, using a flooded nip moistener from Coating Moistening Systems, Atlanta, Ga., to the lower surface of approximately 15,000 linear feet of paperboard plate stock (168 lbs/ream) to achieve a paperboard moisture content of about 10%. The moistened roll of paperboard was subsequently formed into standard 9" paper plates using the same press conditions as used for the commercial product.

Using the same rigidity test apparatus described above, the rigidity was determined for 190 paper plates made using the ordinary production process and 190 plates made using the ordinary process modified with a moistening solution including 8% solids to Tykote Base II, a styrene butadiene polymercoating material. The mean rigidity of the former was 152.295 grams per ¼" deflection and the mean rigidity of the latter was 162.321 grams per ¼" deflection. The test using the standard production facilities, therefore, confirmed the laboratory data and confirmed that application of a functional coating material such as Tykote Base II to the lower surface of the paperboard in a concentration selected to avoid formation of a moisture barrier provides a container with statistically significant improved rigidity.

It is understood that the invention is not confined to the particular construction and arrangement of parts and the particular processes described herein but embraces such modified forms thereof as come within the scope of the following claims.

What is claimed is:

1. A container press-formed of paperboard having a top surface disposed for contact with material to be contained and an opposed bottom surface, the container comprising a first functional coating material dispersed in the paperboard proximate to the bottom surface in an amount effective to not form a barrier to moisture in said press and wherein said paperboard does not blister during rapid heating.

2. The container of claim 1 also including a second functional coating material on the top surface forming a barrier to moisture.

3. The container of claim 2 also including additional layers of functional coating materials on the top surface.

4. The container of claim 1 wherein the first functional coating material is substantially all latex.

5. The container of claim 1 wherein the first functional coating material is substantially all styrene butadiene rubber latex.

6. The container of claim 1, where said paperboard is pressed at 55 strokes per minute or greater.

7. The container of claim 1 wherein the amount of the first functional coating material dispersed in the paperboard is about one-half (½) pound per ream (3000 sq. ft.) of paperboard.

8. The container of claim 1 wherein the basis weight of the paperboard is 162 pounds per ream (3000 sq. ft.).

9. The container of claim 1 wherein the basis weight of the paperboard is 200 pounds per ream (3000 sq. ft.).

10. The container of claim 1 manufactured using the steps of:

a. applying a solution of water and the first functional coating material to the bottom surface, the amount of first functional coating material in the solution being selected to avoid formation of a barrier to moisture on the bottom surface;

b. cutting a blank for the container from the paperboard; and c. press-forming the blank at a predetermined temperature and pressure to form the container.

11. The container of claim 10 wherein about 8–10% of the solution is the first functional coating material.

12. The container of claim 11 wherein the solution also includes a surfactant.

13. The container of claim 10 wherein the first functional coating material is a styrene butadiene rubber latex and wherein the solution comprises about 8–10% solids from the styrene butadiene rubber latex and about 1.0% of a moistening solution containing a polyolefin wax and an ethoxylated surfactant.

14. The container of claim 10 wherein the solution is applied prior to press-forming in an amount sufficient to raise the moisture content of the paperboard to about 8.0 to 12.0%.

15. The container of claim 1 manufactured using the steps of:

a. forming the paperboard;

b. applying the second functional coating material to the top surface of the paperboard;

c. applying a solution of water and the first functional coating material to the bottom surface, the amount of first functional coating material in the solution being selected to avoid formation of a barrier to moisture on the bottom surface; and d. press-forming the blank at a predetermined temperature and pressure to form the container.

16. In a method of manufacturing a press-formed paperboard container having a top surface disposed for contact with material to be contained and an opposed bottom surface, the improvement comprising before the container is rapid press-formed the step of applying to the bottom surface of the paperboard a moistening solution comprising latex solids in an amount selected to avoid blistering on the bottom surface during press forming.

17. The method of claim 16 wherein the moistening solution comprises about 8–10% latex solids, less than 1.0% surfactant and water.

18. The method of claim 16 wherein the moistening solution is applied to the bottom surface in an amount sufficient to obtain a moisture content in the paperboard of about 8–12%.

19. The method of claim 16 wherein the latex is essentially styrene butadiene rubber.

20. The method of claim 16 wherein the container is press formed at a temperature of about 300° F.

* * * * *